US005749758A

United States Patent [19]

Breivik et al.

[11] Patent Number: 5,749,758

[45] Date of Patent: May 12, 1998

[54] VESSEL FOR PRODUCTION AND/OR LOADING/UNLOADING AND TRANSPORT OF HYDROCARBONS FROM OFFSHORE FIELDS, AND/OR FOR CARRYING OUT WELL OPERATIONS

[75] Inventors: Kåre Breivik, Tau; Trygve G. Egge, Hafrsfjord; Sverre Herstad, Langhus, all of Norway

[73] Assignee: Den Norske Stats Oljeselskap A.S., I & K Patent, Stavenger, Norway

[21] Appl. No.: 687,597

[22] PCT Filed: Feb. 1, 1995

[86] PCT No.: PCT/NO95/00022

§ 371 Date: Sep. 12, 1996

§ 102(e) Date: Sep. 12, 1996

[87] PCT Pub. No.: WO95/21091

PCT Pub. Date: Aug. 10, 1995

[30] Foreign Application Priority Data

Feb. 2, 1994 [NO] Norway ..... 940352

[51] Int. Cl.[6] ..... B63B 22/02

[52] U.S. Cl. ..... 441/5; 114/230

[58] Field of Search ..... 441/3–5; 114/230, 114/269; 440/6; 166/352, 353, 354, 356

[56] References Cited

U.S. PATENT DOCUMENTS

| | | | |
|---|---|---|---|
| 1,402,875 | 1/1922 | McCallister | 440/6 |
| 3,129,682 | 4/1964 | Penney | 114/269 |
| 3,335,690 | 8/1967 | Busking | 114/230 |
| 3,602,302 | 8/1971 | Kluth | 166/352 |
| 3,766,938 | 10/1973 | Stracke et al. | 137/355.16 |
| 3,880,105 | 4/1975 | Bryant | 114/230 |
| 4,273,066 | 6/1981 | Anderson | 441/5 |
| 4,606,727 | 8/1986 | Koening et al. | 441/4 |
| 4,677,930 | 7/1987 | Ortloff | 114/230 |
| 5,240,446 | 8/1993 | Boatman et al. | 441/3 |
| 5,456,622 | 10/1995 | Breivik et al. | 441/3 |
| 5,564,957 | 10/1996 | Breivik et al. | 441/5 |

FOREIGN PATENT DOCUMENTS

| | | | |
|---|---|---|---|
| 0 259 072 A1 | 3/1988 | European Pat. Off. . | |
| 2 051 588 | 5/1972 | Germany . | |
| 311/73 | 7/1973 | Norway . | |
| 140 292 | 5/1974 | Norway . | |
| 153 092 | 9/1979 | Norway . | |
| 166 479 | 5/1986 | Norway . | |
| 923 814 | 6/1993 | Norway . | |
| 922 045 | 11/1993 | Norway . | |
| 2 069 955 | 9/1981 | United Kingdom . | |
| 2275230 | 8/1994 | United Kingdom | 441/3 |
| WO 93/11032 | 6/1993 | WIPO . | |
| WO 93/24731 | 12/1993 | WIPO . | |
| WO 93/24733 | 12/1993 | WIPO . | |
| WO 95/01904 | 1/1995 | WIPO . | |

OTHER PUBLICATIONS

English–language Abstract from the Dialog® computer service (Derwent World Patent Index) for German Patent No. 2 051 588 (Item B1).

English–language Abstract from the Dialog®computer service (Derwent World Patent Index) for Norwegian Patent Application 922 045 (Item B9).

*Primary Examiner*—Sherman Basinger

*Attorney, Agent, or Firm*—Marshall, O'Toole, Gerstein, Murray & Borun

[57] ABSTRACT

A vessel for use in offshore production or transport of hydrocarbons, and/or for loading/unloading of hydrocarbons, and/or for carrying out well operations. The vessel at its forward end is equipped with a submerged receiving space for receiving a bottom-anchored underwater buoy. A service shaft extends between the receiving space and the deck of the vessel. At the stern of the vessel, a coupling head is provided along with equipment for the connection of a hose for loading and unloading of oil.

8 Claims, 5 Drawing Sheets

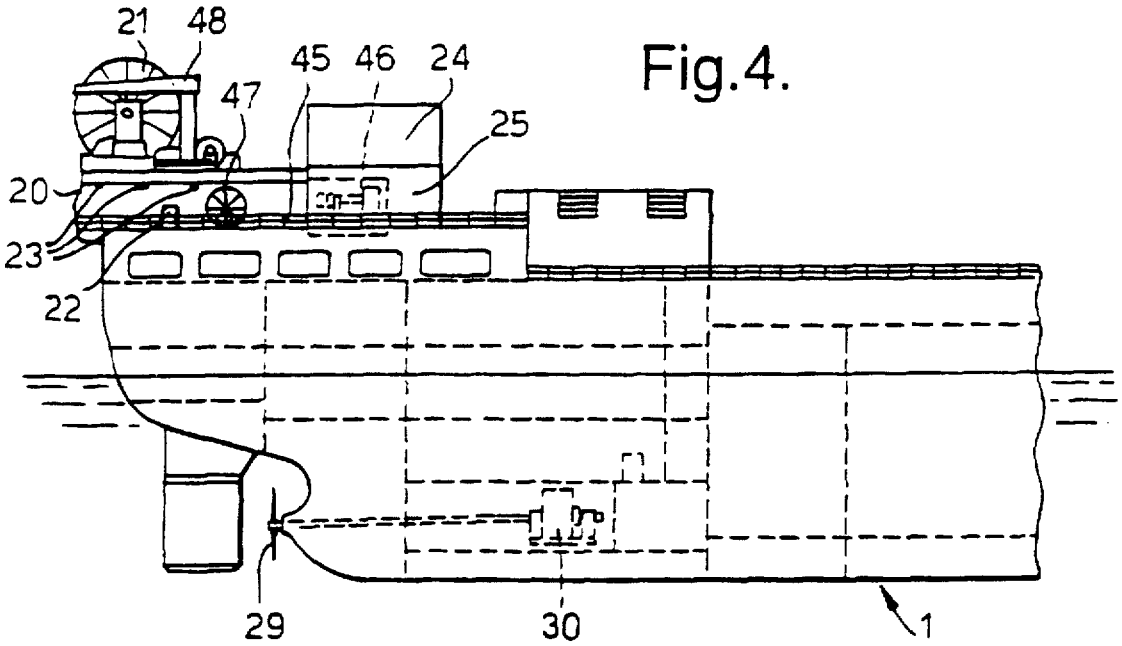
Fig.4.
Fig.5.
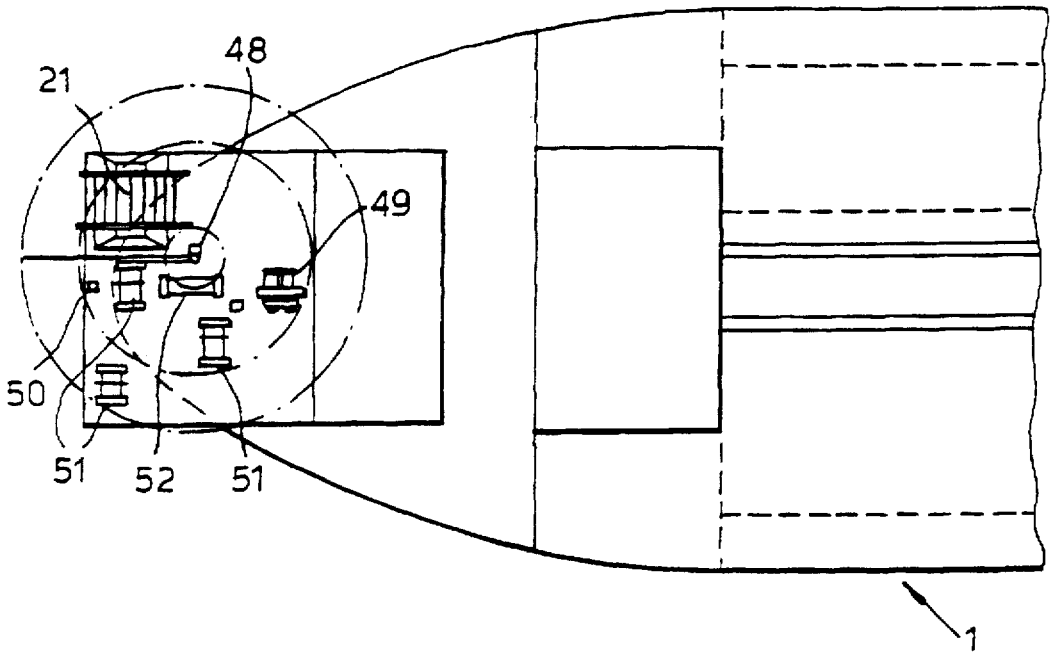

VESSEL FOR PRODUCTION AND/OR LOADING/UNLOADING AND TRANSPORT OF HYDROCARBONS FROM OFFSHORE FIELDS, AND/OR FOR CARRYING OUT WELL OPERATIONS

BACKGROUND OF THE INVENTION

1. Field of the Invention

The invention relates to a vessel for use in production or transport of hydrocarbons from offshore fields. Further, the invention relates to a method for loading of oil from a loading hose which is connected to an underwater buoy and which, for connection, is pulled up onto the deck of a vessel and connected to a loading manifold on the deck.

2. Brief Description of the Prior Art

There are previously known ships which are used for transport of oil from offshore loading buoys to e.g. a land-based oil terminal (shuttle tankers). These load oil via a loading hose from the loading buoy, the hose being pulled over the bow of the ship and connected to a coupling head on the ship.

Recently, there have also become known shuttle tankers which are arranged to connect themselves to underwater loading buoys which simultaneously keep the ship anchored. There has also been proposed such a buoy which comprises a swivel unit having several pipe courses and which is adapted for production purposes.

There are also known storage vessels which are fixedly anchored, and are connected to a production platform via a hose or pipeline. Unloading takes place via a loading system which is placed at the stern of the ship where it is connected to a loading hose which is pulled over the bow of a shuttle tanker.

It is an object of the invention to provide a vessel which by simple means is able to change between operating as a) a production vessel which is connected to an underwater buoy by means of a swivel, b) a shuttle tanker which connects itself to a submerged loading buoy, c) a storage vessel which is permanently connected to an underwater buoy, and which simultaneously has unloading equipment at the stern of the vessel for unloading oil, and d) a shuttle tanker which connects itself to loading hoses pulled over the deck of the tanker.

SUMMARY OF THE INVENTION

The above-mentioned object is achieved with a vessel of the introductorily stated type which, according to the invention, is characterized in that the vessel near to its forward end comprises a submerged receiving space for receiving an underwater buoy, and a service shaft extending between the receiving space and the deck of the vessel, and that the vessel further, at its stern on the deck, comprises a coupling head and equipment for connection of a hose for loading/unloading of oil.

An advantageous embodiment of the vessel according to the invention is characterized in that its stern in plan view has a pointed, rounded shape (bow shape). By means of this embodiment there is achieved that the forces acting on the stern because of waves and wind, are reduced as much as possible. An additional advantage of this hull shape is achieved if a load transfer between two vessels is to be undertaken. If the vessels during the load transfer should get in contact with each other, possible damages will be substantially reduced compared to if the vessel has a traditional, transverse stern which the rearwardly located vessel runs into.

The placing of loading/unloading equipment at the stern of the vessel has an additional advantage if the vessel operates as a traditional shuttle tanker and is to load from a submerged hose, for example in connection with a buoy of the UKOLS type. In such situations the vessel will be lying with the bow against the wind and connect itself to the loading hose with the stern to leeward.

With traditional connection, with loading equipment arranged on the bow, and with the bow placed in position against the wind when connecting, that which limits the loading operation, when the ship is able to connect itself to the loading hose and remain connected, will be the security of the crew moving on the deck and carrying out the connection. With waves having a significant wave height one of around 5.5 meters is today prevented from carrying out loading.

By carrying out loading at the lee end of the vessel, one can effect connection and continue loading at wave heights up to 8 m significant wave height.

Thus, according to the invention, there is also provided a method of the introductorily stated type which, according to the invention, is characterized in that the loading manifold is placed at the stern of the vessel, that the ship prior to the connection is positioned with the bow towards the wind at the windward side of the buoy, and that the vessel is moved form this position so that its stern gets into position to be connected to the loading hose.

It is an additional advantage of the invention that the wheelhouse of the vessel and its engine room can be placed quite at the bow portion of the vessel. The service shaft up from the receiving space of the vessel then will be placed just behind the wheelhouse, and thus will be under the lee of the wheelhouse. With such a configuration there is simultaneously obtained a large deck area from the rearward part of the wheelhouse and backwards to the rearward deck area. When the vessel is to be used as a production vessel, this area will be able to be used for necessary process equipment and equipment for well control.

Since the vessel is to be able to change between different fields of activity, it is preferable that the whole process installation is divided into smaller portable modules.

The invention will be further described below with reference to the drawings, wherein

BRIEF DESCRIPTION OF THE DRAWINGS

FIG. 4 shows a side view of the rearward part of the vessel;

FIG. 5 shows a plan view of the stern of the vessel;

DETAILED DESCRIPTION OF THE INVENTION

Figure 1:
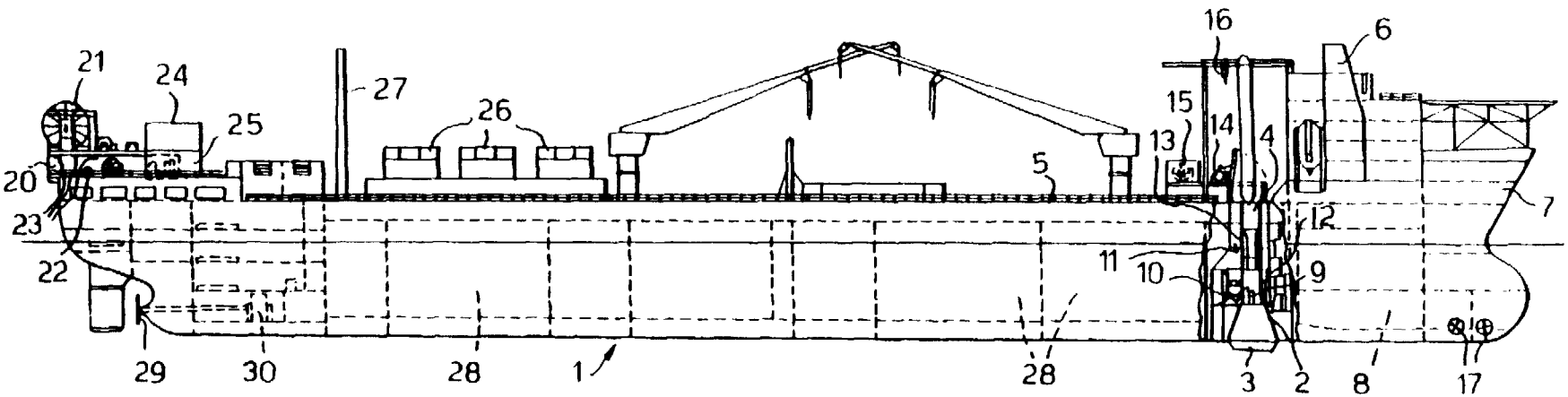
FIG. 1 shows a side view of a vessel according to the invention.

A vessel 1 according to the invention is schematically shown in side view in FIG. 1. As shown, at the forward end of the vessel there is arranged a submerged, downwardly open receiving space 2 for receiving an underwater buoy 3, and a service shaft 4 extends between the receiving space 2 and the deck 5 of the vessel. The arrangement is designed such that a submerged buoy for loading/unloading of hydrocarbons can be pulled up and secured in the receiving space, as further shown and described in the Norwegian patent applications Nos. 923814–923816, and further such that a buoy which is arranged to cooperate with a swivel unit arranged at the lower end of the shaft, can be pulled up and secured, for use of the vessel as a production vessel, as further shown and described in the Norwegian patent applications Nos. 922043–922045. Reference is here made to said applications, for a further description of the topical embodiments.

Since the forward part of the vessel essentially is constructed in accordance with prior art, only an overview of the most essential ones of the parts and elements shown in the Figure will be given here.

As appears, the wheelhouse 6 of the vessel is placed near to the bow 7 of the vessel, and further the engine room 8 with the diesel-electric main machinery thereof is placed below the wheelhouse. The service shaft 4, which extend between the buoy 3 and the deck 5 of the vessel, is placed just behind the wheelhouse, so that crew which is to go down into the shaft, will be in lee behind the wheelhouse.

Above the buoy there is shown to be arranged a loading manifold/swivel 9 for connection to the buoy 3, and also a connecting pipe with an oil pipe valve 10. Loading manifold/swivel 9 is movable such that it can be taken away from the shaft and clear the shaft when the swivel is not in use. Further, there are shown monitoring means 11, e.g. TV cameras, a shutter 12 for shutting-off the shaft 4 over the receiving space, and a guide means 13 for use in connection with pulling-up of the buoy. On the deck there is further shown to be arranged a pulling winch 14, a storage unit 15 and a service crane 16 for use in connection with i.a. maintenance. In the bow of the vessel there is arranged a pair of bow propellers 17.

At the rearward end of the vessel there is i.a. arranged equipment for loading/unloading of oil by means of equipment which is also essentially based on prior art. On the previously known, conventional vessels such equipment is arranged in the bow portion thereof, whereas—on the present vessel—it is arranged at the stern of the vessel. This implies substantial operational advantages, as also mentioned in the introduction, and in combination with the aforementioned receiving space and the appurtenant equipment at the forward end of the vessel there are obtained substantial advantages with respect to flexibility and versatile use of the vessel.

From the main elements arranged on the deck at the stern of the vessel, FIG. 1 shows a coupling head in the form of a loading manifold 20 with a swivel, a hose windless 21, a hose handling winch 22 and TV monitoring equipment 23. Further, there are shown a control room 24 and a hydraulics room 25. Additional elements forming part of the loading/unloading equipment at the stern are to be mentioned in connection with FIGS. 4–6.

Process equipment for the processing of oil is arranged on the deck between the forward and the rearward part of the vessel. This equipment is shown in the form of a number of portable modules 26. Between the forward and the rearward part, the vessel contains a number of cargo compartments or tanks 28. In the rearward area there is also shown to be arranged a flare boom 27. The main propeller 29 of the vessel is shown to be connected to an electric driving motor 30.

Some of the different combination possibilities as regards applications of the vessel according to the invention, are to be mentioned below.

Figure 2:
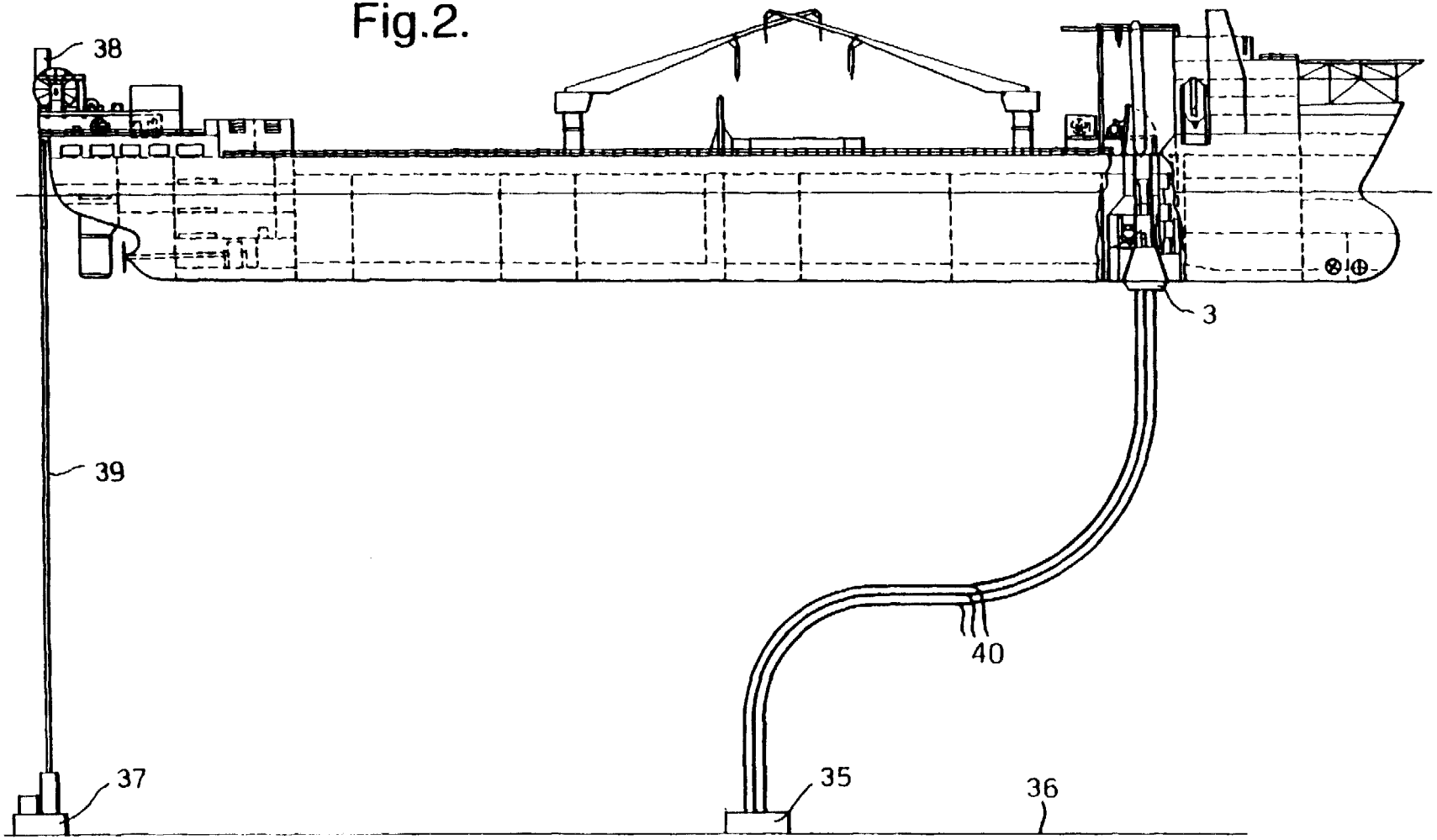
FIG. 2 shows a side view of the vessel wherein oil is produced form a manifold at the sea bed, at the same time as maintenance is effected of an oil well which is connected to the manifold.

FIG. 2 shows an application wherein produced oil from an oil well is supplied to the vessel from a manifold 35 at the sea bed 36, at the same time as maintenance is effected of an oil well 37 which is connected to the manifold 35. In this case necessary equipment for carrying out the maintenance operations is arranged at the stern of the vessel, where the equipment by suitable means 38 is guided down to the well head via e.g. a wire or pipeline 39. Then manifold 35 at the sea bed is connected to the buoy 3 via flexible risers 40. As described in the aforementioned patent applications, the buoy 3 is bottom-anchored by means of a suitable anchor system (not shown in the drawings), so that the buoy also constitutes an anchoring buoy for the vessel.

This application of the vessel is particularly advantageous when a number of wells 37 are arranged in a circle at the sea bed around the manifold 35, and the distance between the manifold and the wells is essentially equal to the length of the vessel. The vessel then can be permanently connected to the manifold 35 via the buoy 3, and produce oil from the manifold, at the same time as maintenance of the different wells can be carried out from the stern of the vessel, the vessel being able to be turned about the buoy as required, so that its stern can be placed over the well of interest. In this manner maintenance/control of bottom-mounted multiphase equipment and process equipment can be carried out during production, which is very advantageous, especially in deep waters.

The vessel of course also can be used only for production from an oil well via the buoy in the receiving space, or only for well maintenance via the rearward end of the vessel, without combining these operations. Possible, well maintenance can be carried out via the service shaft 4 and the receiving space 2, with dynamic positioning of the vessel.

Figure 3:
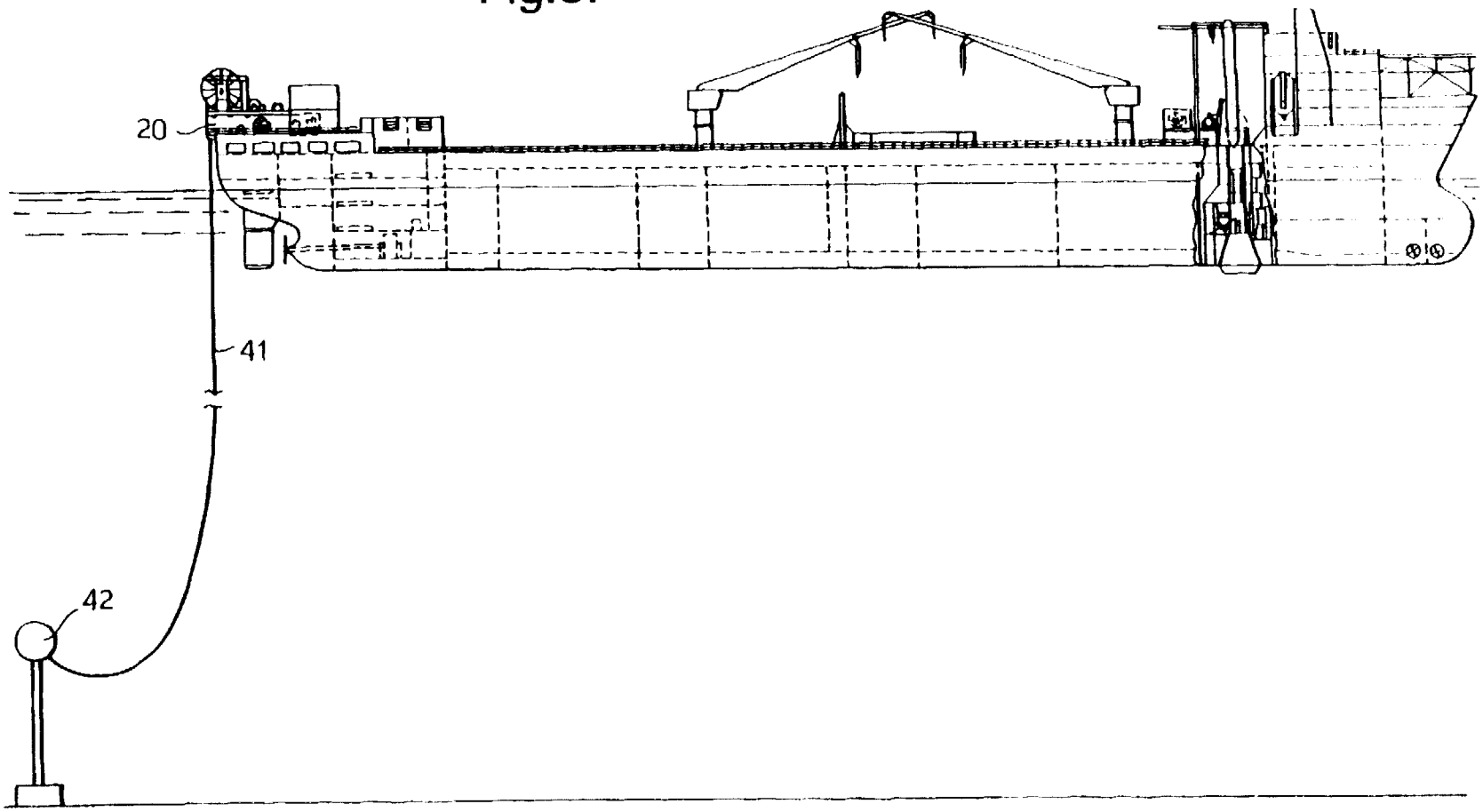
FIG. 3 shows a side view of the vessel when loading from a loading hose which is connected to an underwater buoy.

FIG. 3 shows another application wherein oil is loaded from a loading hose 41 which is connected to an underwater buoy 42, the hose being pulled up onto the deck of the vessel and connected to the loading manifold 20. Such buoy loading advantageously is carried out in accordance with the method mentioned in the introduction.

Oil may also be loaded via a transfer conduit or a riser which is coupled to a loading buoy in the receiving space, where the buoy is of the type which, for example, is mentioned in the aforementioned Norwegian patent application No. 923815.

Oil loading also may take place via the stern of the vessel in connection with other types of loading devices, e.g. spar-buoy buoys (spar type loading), buoys floating on the surface of the water, or articulated (buoy) columns.

The vessel also may be used for carrying out well tests, both via the forward service shaft and from the stern of the vessel, in both cases with dynamic positioning.

The vessel also may constitute a storage for oil, and according to requirement unload the oil over to e.g. a shuttle tanker by means of a hose connection between the stern of the vessel and the shuttle tanker.

The different parts and elements arranged on the vessel according to the invention are more clearly shown in the enlarged views in FIGS. 4–7.

In addition to the elements mentioned above, in the side view of FIG. 4 and in the plan view of FIG. 5 there are shown a guide roller 45, a hydraulic pump station 46, a storage unit 47, a service crane 48, a pulling winch 49, a fairlead 50, bunker line drums 51 and a chain stopper 52.

Figure 6:
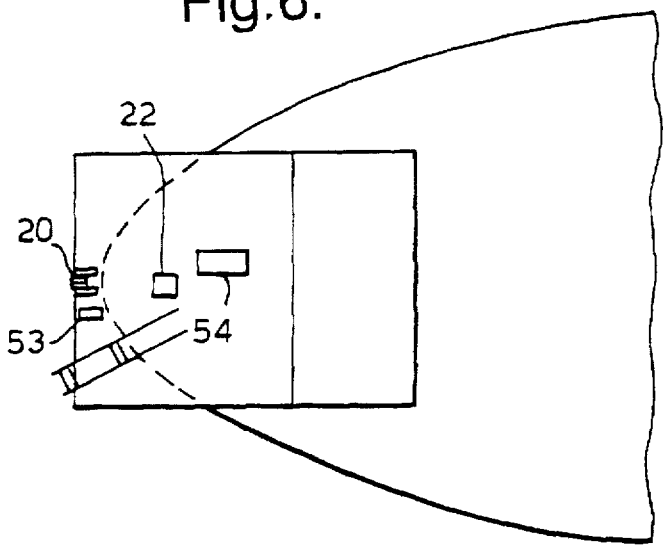
FIG. 6 shows a plan view of the poop deck of the vessel.

FIG. 6 shows the poop deck of the vessel where the loading manifold 20 and the hose handling winch 22 are arranged. Further, the Figure shows a manifold control console 53 and a storage unit 54.

Figure 7:
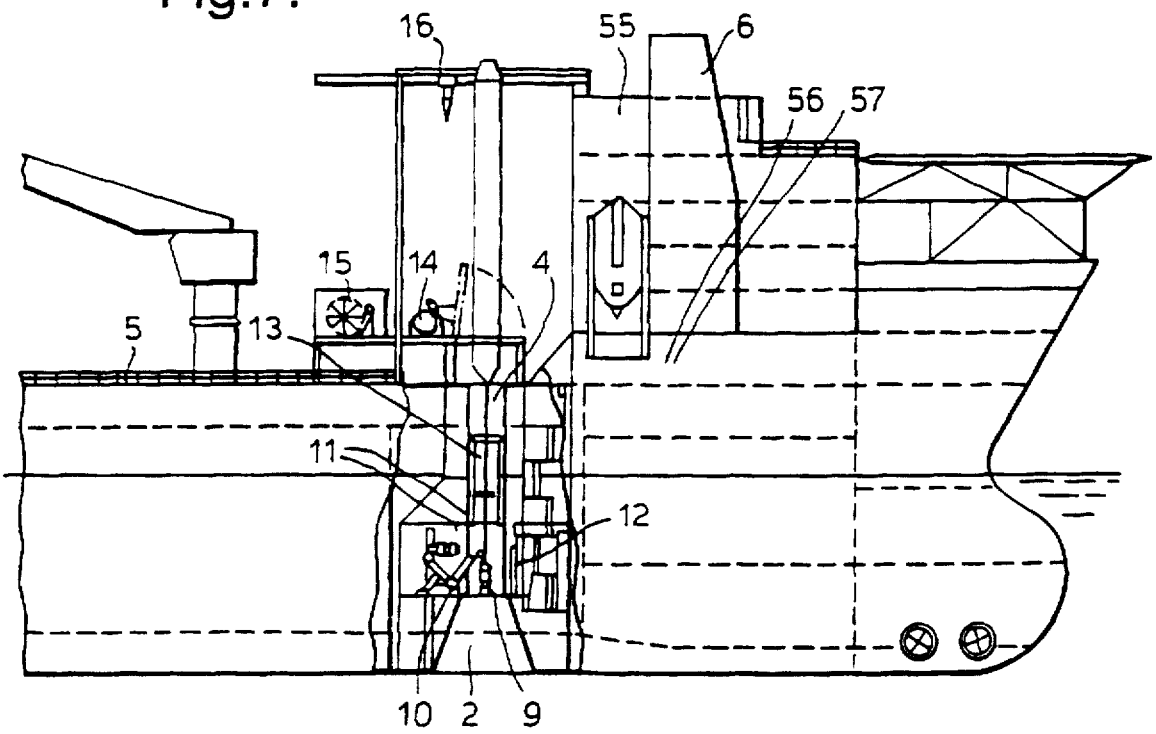
FIG. 7 shows a side view of the forward part of the vessel.

In FIG. 7, which shows the forward part of the vessel, the buoy 3 is omitted. In addition to the parts and elements mentioned above there is suggested, in connection with the wheelhouse 6, a steering console 55 arranged ont he navigating bridge, and there are also suggested a hydraulic pump station 56 and starter cabinets 57. In other respects reference is made to the aforementioned patent applications, for a further description of the constructive embodiments of the buoy, and the equipment arranged in connection with the receiving space and the service shaft.

We claim:

1. A vessel capable of alternating between operation as a production ship for hydrocarbon production, as a storage ship on offshore fields, and as a shuttle tanker, the vessel comprising in combination:

(a) a submerged, downwardly-open receiving space at a bow of the vessel for receiving a bottom-anchored underwater buoy for transfer of hydrocarbons, (b) a service shaft extending between the receiving space and a deck of the vessel, (c) a swivel unit arranged at a lower end of the service shaft, for connection of the buoy to a pipe system on the vessel, the swivel unit being movably arranged to be taken away from the shaft and clear the shaft when the swivel is not in use, (d) a coupling head and equipment for connection of a hose for loading/unloading of oil, the coupling head being disposed at a stern of the vessel, and the equipment being disposed at the stern for execution of operations on sea bed installations or wells at the same time as the vessel is anchored to the underwater buoy.

2. A vessel according to claim 1, wherein the stern in plan view has a pointed, rounded shape.

3. A vessel according to claim 2, having a wheelhouse placed near to the forward end of the vessel, and wherein the receiving space for the buoy and the service shaft up from the receiving space are placed just behind the wheelhouse, so that crew going down into the shaft will be in lee behind the wheelhouse.

4. A vessel according to claim 2, wherein equipment for execution of operations on sea bed installations or wells is also arranged in connection with the service shaft.

5. A vessel according to claim 1, having a wheelhouse placed near to the bow of the vessel, and wherein the receiving space for the buoy and the service shaft up from the receiving space are placed just behind the wheelhouse, so that crew going down into the shaft will be in lee behind the wheelhouse.

6. A vessel according to claim 1, wherein the equipment for execution of operations on sea bed installations or wells is also arranged in connection with the service shaft.

7. A method of loading oil from a loading hose connected to an underwater buoy, wherein the hose is connected to a vessel having a bow, a stern, a deck, a submerged receiving space disposed at the bow for receiving an underwater buoy, a service shaft extending between the receiving space and the deck, and a coupling head and equipment disposed on the deck at the stern for connection of the loading hose, the method comprising the steps of:

a. positioning the vessel with the bow towards the wind at the windward side of the buoy, b. moving the vessel from position (a) so that the stern gets into position to be connected to the loading hose, c. pulling the loading hose up onto the deck, and d. connecting the loading hose to a manifold of the coupling head at the stern.

8. A method of loading oil from a loading hose connected to an underwater buoy, wherein the hose is connected to a vessel capable of alternating between operation as a production ship for hydrocarbon production, as a storage ship on offshore fields, and as a shuttle tanker, the vessel including a submerged, downwardly-open receiving space at a bow of the vessel for receiving a bottom-anchored underwater buoy for transfer of hydrocarbons, a service shaft extending between the receiving space and a deck of the vessel, a swivel unit arranged at a lower end of the service shaft, for connection of the buoy to a pipe system on the vessel, the swivel unit being movably arranged, to be taken away from the shaft and clear the shaft when the swivel is not in use, a coupling head and equipment for connection of a hose for loading/unloading of oil, the coupling head being disposed at a stern of the vessel, and the equipment being disposed at the stern for execution of operations on sea bed installations or wells at the same time as the vessel is anchored to the underwater buoy; the method comprising the steps of:

(a) positioning the vessel with the bow towards the wind at the windward side of the buoy, (b) moving the vessel from position (a) so that the stern gets into position to be connected to the loading hose, (c) pulling the loading hose up onto the deck, and (d) connecting the loading hose to a manifold of the coupling head at the stern.

* * * * *